US006932126B1

(12) United States Patent
Spagnolo

(10) Patent No.: US 6,932,126 B1
(45) Date of Patent: Aug. 23, 2005

(54) SANDBAG FILLING SYSTEM

(76) Inventor: Andrew J. Spagnolo, P.O. Box 4, Llano, CA (US) 43544

( * ) Notice: Subject to any disclaimer, the term of this patent is extended or adjusted under 35 U.S.C. 154(b) by 0 days.

(21) Appl. No.: 10/884,569

(22) Filed: Jul. 3, 2004

(51) Int. Cl.[7] ..... B65B 1/04
(52) U.S. Cl. ..... 141/316; 141/114; 141/313; 141/314; 248/99
(58) Field of Search ..... 141/10, 18, 114, 141/313–316, 391; 248/95–101

(56) References Cited

U.S. PATENT DOCUMENTS 5,397,085 A * 3/1995 Spagnolo ..... 248/97
5,456,431 A * 10/1995 Ilnisky ..... 248/98

* cited by examiner

*Primary Examiner*—Timothy L. Maust
(74) *Attorney, Agent, or Firm*—Edward P. Dutkiewicz

(57) ABSTRACT

An open frame has a base. The base has horizontal parallel legs. The base has first free ends and second ends. An integral horizontal connecting leg is between the legs. The open frame has a pivotable support. The open frame has angled legs. The angled legs have lower ends and upper ends. A connecting plate is provided between the ends. The open frame also has a pair of pivot brackets. Each bracket has a lower pin pivotably extending through the first end of a horizontal leg. Each bracket has an upper pin pivotably extending through the lower end of an angled leg. A cylindrical lower hoop is coupled to the connecting plate. A cylindrical upper hoop has an operative position such that it is centered over the first hoop. Secured to the upper hoop is a plate. The second hoop may be rotated from the first hoop.

4 Claims, 4 Drawing Sheets

FIG 1
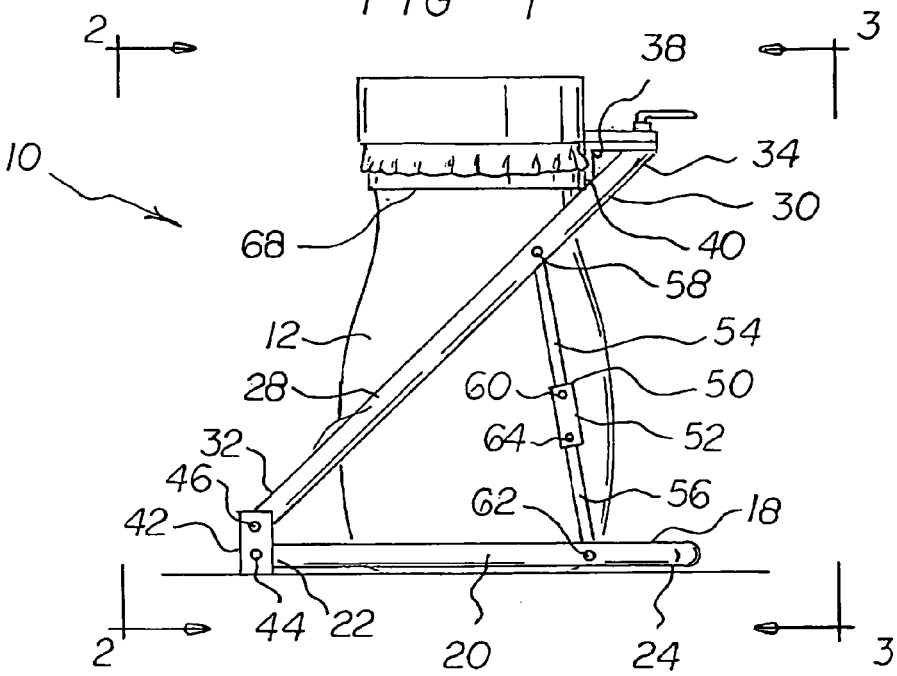
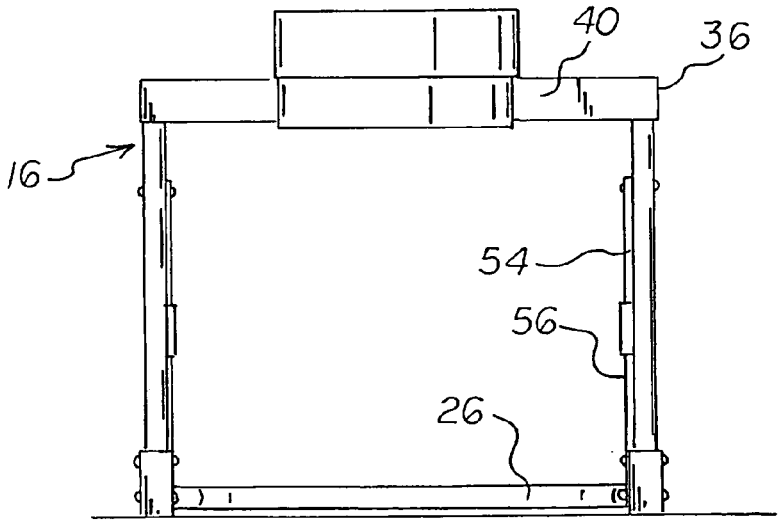
FIG 2

FIG 5
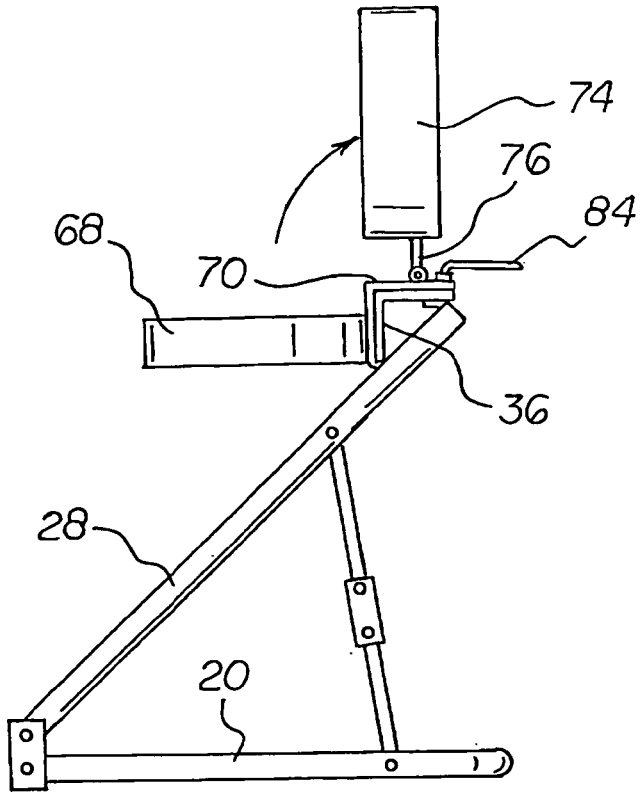
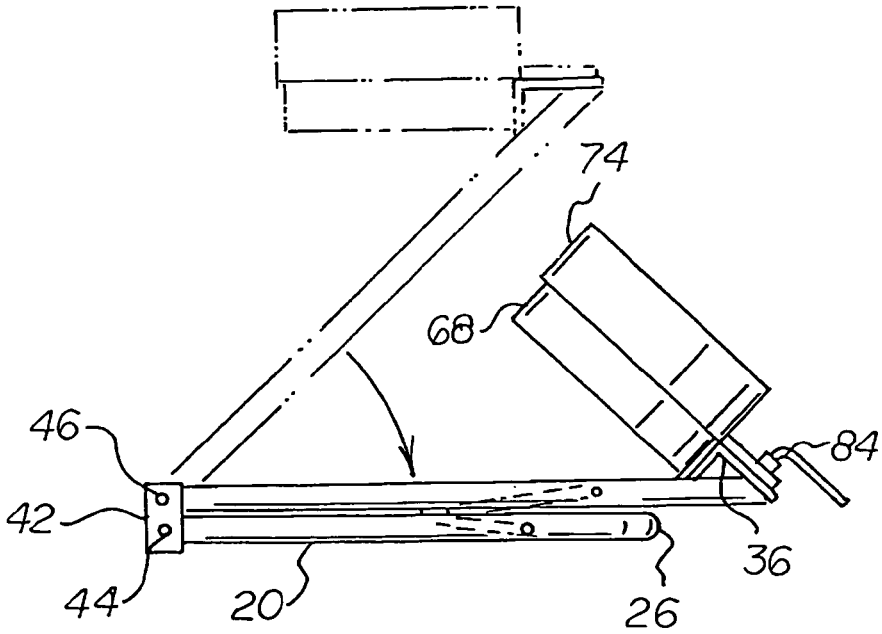
FIG 6

SANDBAG FILLING SYSTEM

BACKGROUND OF THE INVENTION

1. Field of the Invention

The present invention relates to a sandbag filling system and more particularly pertains to supporting a sandbag in an upright position to enable a single person to rapidly and efficiently fill sandbags during emergency situations.

2. Description of the Prior Art

The use of filling systems of known designs and configurations is known in the prior art. More specifically, filling systems of known designs and configurations previously devised and utilized for the purpose of filling a container using known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,976,406 to Buckley et al. discloses a portable, self-supporting, collapsible utility stand for supporting a trash bag or the like in an upright manner with its top open to receive the deposit of trash or other material therein. U.S. Pat. No. 5,080,308 to Franks discloses a bag support for maintaining the mouth of a bag in an open position that includes a base which is sized to be received within the bag and a pair of spaced apart support arms secured to the base; each of the support arms include two rigid portions connected by a resilient member. Additionally, U.S. Pat. No. 4,723,742 to Krauss discloses a sandbag support incorporating a pair of U-shaped edge upstanding panel members. All three of the above inventions consist of frail structural elements which would not withstand service at an emergency sandbagging operation. The prior art also discloses a trash bag holder as shown in U.S. Pat. No. 5,058,839 to Stevens which consists of a pair of circular support members interconnected by a pair of legs. The legs pivot at their respective midpoints such that the trash bag can be collapsed into a folded position for easy storage or carrying. U.S. Pat. No. 5,183,226 to Brooks describes a universal collapsible bag support stand having upper and lower bag retainer rings interconnected at spaced apart locations by a pair of straight tubular column members. U.S. Pat. No. 5,397,085 to Spagnolo describes a sandbag filling aid but without the capability of folding when not in an operative orientation.

While these devices fulfill their respective, particular objectives and requirements, the aforementioned patents do not describe sandbag filling system that allows supporting a sandbag in an upright position to enable a single person to rapidly and efficiently fill sandbags during emergency situations.

In this respect, the sandbag filling system according to the present invention substantially departs from the conventional concepts and designs of the prior art, and in doing so provides an apparatus primarily developed for the purpose of supporting a sandbag in an upright position to enable a single person to rapidly and efficiently fill sandbags during emergency situations.

Therefore, it can be appreciated that there exists a continuing need for a new and improved sandbag filling system which can be used for supporting a sandbag in an upright position to enable a single person to rapidly and efficiently fill sandbags during emergency situations. In this regard, the present invention substantially fulfills this need.

SUMMARY OF THE INVENTION

In view of the foregoing disadvantages inherent in the known types of filling systems of known designs and configurations now present in the prior art, the present invention provides an improved sandbag filling system. As such, the general purpose of the present invention, which will be described subsequently in greater detail, is to provide a new and improved sandbag filling system and method which has all the advantages of the prior art and none of the disadvantages.

To attain this, the present invention essentially comprises an open frame. The open frame has a U-shaped base. The base has parallel horizontal legs. The horizontal parallel legs have first free ends and second ends. An integral horizontal connecting leg is provided between the first and second ends. The open frame also has a pivotable support. The support has parallel angled legs. The parallel angled legs have lower ends and upper ends. A connecting plate is provided between the lower and upper ends. The connecting plate is provided in an L-shaped cross sectional configuration. A primary section is provided above the frame. The primary section has a slot. A secondary section is provided. The secondary section extends downwardly. The legs are formed of rigid structural material such as tubular steel. The open frame also has a pair of pivot brackets. Each pivot bracket has a lower pin. The lower pin pivotably extends through the first end of a horizontal leg. Each pivot bracket has an upper pin. The upper pin pivotably extends through the lower end of an angled leg.

A pair of support assemblies is provided. Each support assembly has a support bracket. Each support assembly has an upper arm and a lower arm. Each upper arm has an upper end with a pin. The pin extends through the upper end and through an angled leg adjacent to its upper end. Each upper arm has a lower end with a pin. The pin extends through the lower end and through a support bracket. Each lower arm has a lower end with a pin. The pin extends through the lower end and through a horizontal leg adjacent to its second end. Each lower arm has an upper end with a pin. The pin extends through the upper end and through a support bracket. The open frame is adapted to be held in an operative orientation. The arms are in alignment and the legs are at an angle. The frame is adapted to be held in an inoperative orientation. The arms are in closely spaced parallelism. The legs are also in closely spaced parallelism.

Provided next is a lower hoop with an intermediate plate. The intermediate plate is formed with a central section, and with two fingers extending rearwardly at the bottom of the central section, and with an upper section positionable extending rearwardly at the top of the central section. The lower loop is formed of rigid structural material such as steel band. The lower hoop has a diameter slightly smaller than the diameter of the mouth of a sandbag. In this manner a sandbag may be inserted and slightly overlapped such as to hold the sandbag in an upright open position for being filled. The lower hoop is welded to couple with the center of the secondary section of the intermediate plate. In this manner the lower loop is fixedly centered between the legs and above the centers of the legs.

Further provided is an upper hoop. The upper hoop is formed of the same material as the first horizontal hoop. The second horizontal hoop has a diameter slightly larger than the diameter of the mouth of a first hoop. The second hoop has an operative position such that it is centered over the first horizontal hoop. In this manner a sandbag is allowed to be inserted onto the first hoop and removably clamped between the first and second hoops. The second hoop also has two pivoting bars secured to the second hoop. In this manner the second hoop may be pivoted upwardly from the first hoop for removing a filled sand bag and for positioning an empty sandbag onto the system for filling.

Provided last is a securement assembly. The securement assembly allows for locking and unlocking of the intermediate plate with respect to the connecting plate. The securement assembly includes an aperture through the intermediate plate with a rod extending through the aperture and the slot. The bolt has a finger below the aperture. A handle is provided above the aperture. In this manner the rotation of the handle and finger in one direction will lock the intermediate plate with respect to the connecting plate and the rotation of the handle and finger in the opposite direction will unlock the intermediate plate with respect to the connecting plate.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved sandbag filling system which has all of the advantages of the prior art filling systems of known designs and configurations and none of the disadvantages.

It is another object of the present invention to provide a new and improved sandbag filling system which may be easily and efficiently manufactured and marketed.

It is further object of the present invention to provide a new and improved sandbag filling system which is of durable and reliable constructions.

An even further object of the present invention is to provide a new and improved sandbag filling system which is susceptible of a low cost of manufacture with regard to both materials and labor, and which accordingly is then susceptible of low prices of sale to the consuming public, thereby making such sandbag filling system economically available to the buying public.

Even still another object of the present invention is to provide a sandbag filling system for supporting a sandbag in an upright position to enable a single person to rapidly and efficiently fill sandbags during emergency situations.

Lastly, it is an object of the present invention to provide a new and improved sandbag filling system. An open frame has a base. The base has horizontal parallel legs. The base has first free ends and second ends. An integral horizontal connecting leg is between the legs. The open frame has a pivotable support. The open frame has angled legs. The angled legs have lower ends and upper ends. A connecting plate is provided between the ends. The open frame also has a pair of pivot brackets. Each bracket has a lower pin pivotably extending through the first end of a horizontal leg. Each bracket has an upper pin pivotably extending through the lower end of an angled leg. A cylindrical lower hoop is coupled to the connecting plate. A cylindrical upper hoop has an operative position such that it is centered over the first hoop. Secured to the upper hoop is a plate. The second hoop may be rotated from the first hoop.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a sandbag filling system constructed in accordance with he principles of the present invention.

FIG. 2 is a rear elevational view of the, taken along the line 2—2 of FIG. 1.

FIG. 5 is a side elevational view similar to FIG. 1 but illustrating the top hoop in a rotated inoperative orientation.

FIG. 6 is a side elevational view similar to FIGS. 1 and 5 but collapsed into the inoperative orientation.

The same reference numerals refer to the same parts throughout the various Figures.

DESCRIPTION OF THE PREFERRED EMBODIMENT

Figure 3:
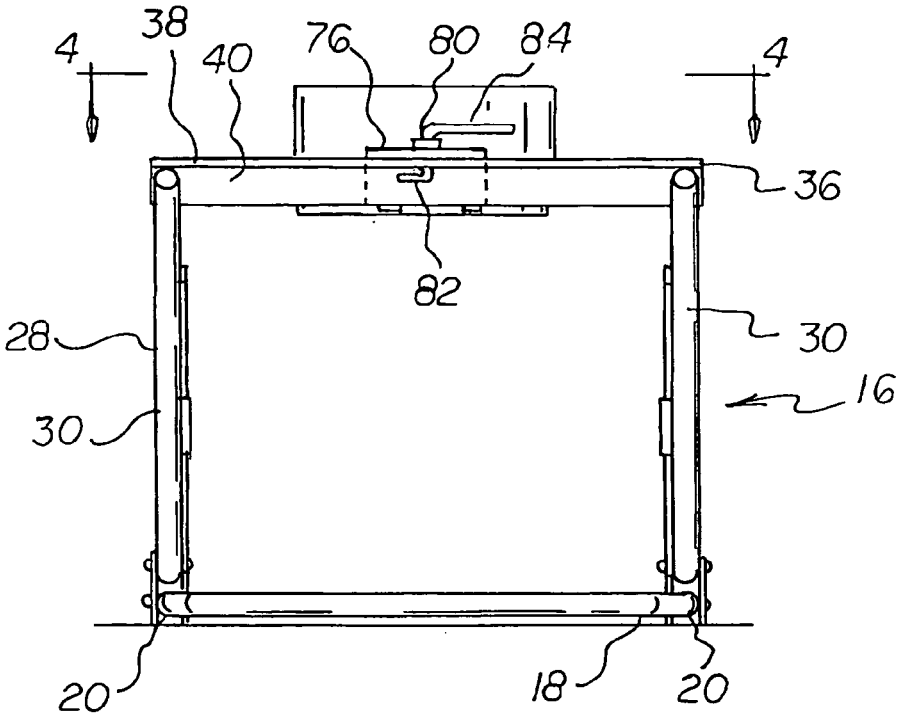
FIG. 3 is a front elevational view of the invention, taken along the line 3—3 of FIG. 1.
Figure 4:
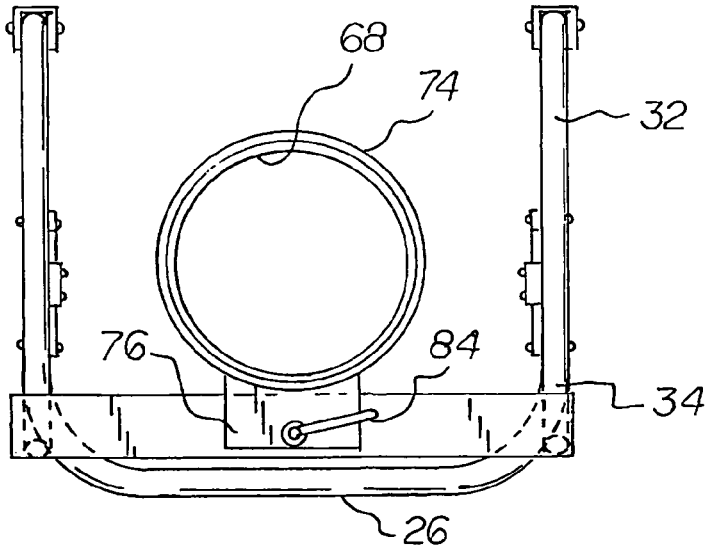
FIG. 4 is a plan view of the invention, taken along the line 4—4 of FIG. 3.
Figure 7:
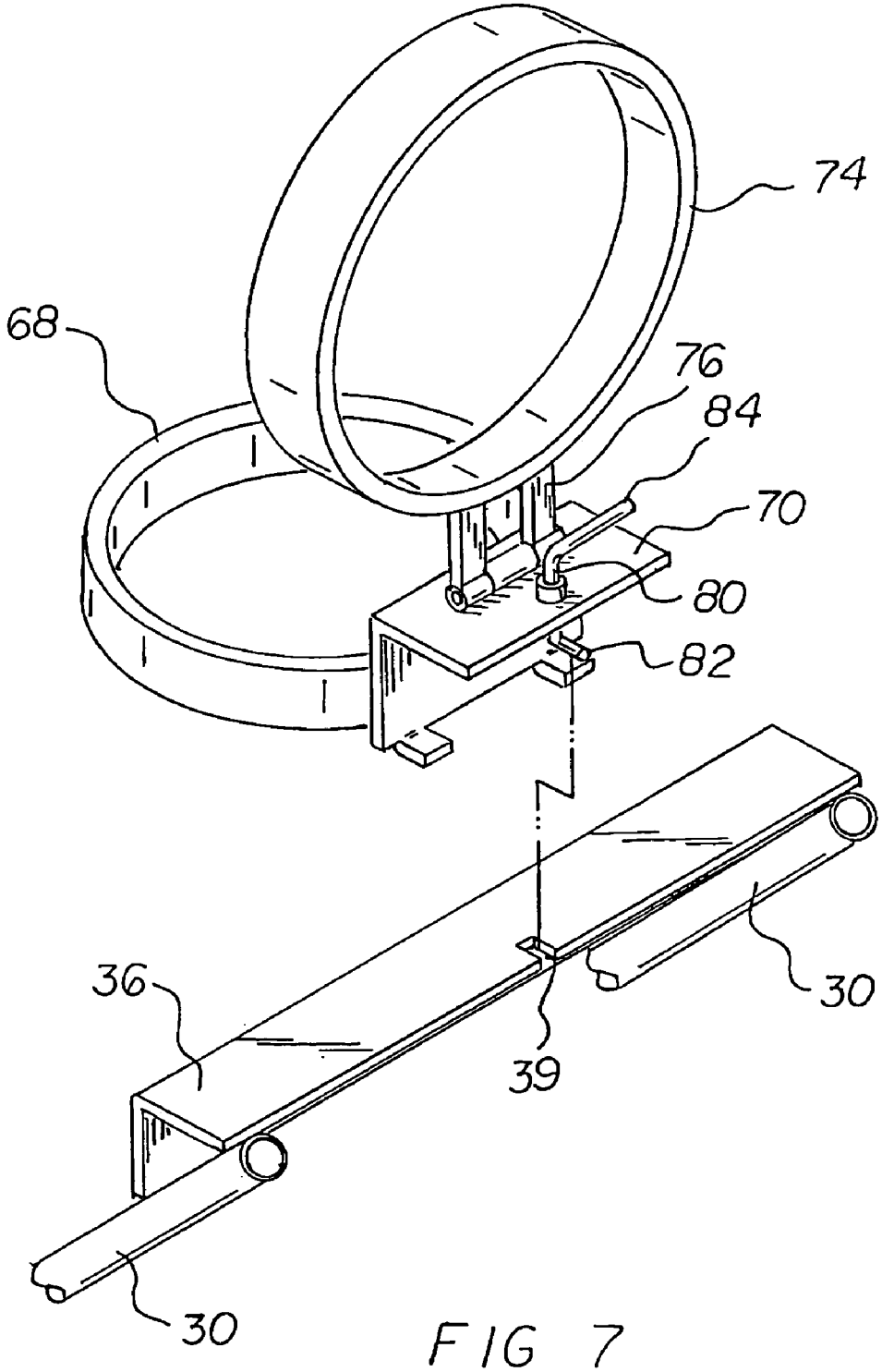
FIG. 7 is an exploded perspective view of the upper portions of the system shown in the prior Figures.

With reference now to the drawings, and in particular to FIG. 1 thereof, the preferred embodiment of the new and improved sandbag filling system embodying the principles and concepts of the present invention and generally designated by the reference numeral 10 will be described.

The present invention, the sandbag filling system 10 is comprised of a plurality of components. Such components in their broadest context include an open frame, a cylindrical lower hoop and a cylindrical upper hoop. Such components are individually configured and correlated with respect to each other so as to attain the desired objective.

First provided is an open frame 16. The open frame has a U-shaped base 18. The base has parallel horizontal legs 20. The horizontal parallel legs have first free ends 22 and second ends 24. An integral horizontal connecting leg 26 is provided between the first and second ends. The open frame also has a pivotable support 28. The support has parallel angled legs 30. The parallel angled legs have lower ends 32 and upper ends 34. A connecting plate 36 is provided between the lower and upper ends. The connecting plate is provided in an L-shaped cross sectional configuration. A primary section 38 is provided above the frame. The primary section has a slot 39. A secondary section 40 is provided. The secondary section extends downwardly during operation and use. The legs are formed of rigid structural material such as tubular steel. The open frame also has a pair of pivot brackets 42. Each pivot bracket has a lower pin 44. The lower pin pivotably extends through the first end of a horizontal leg. Each pivot bracket has an upper pin 46. The upper pin pivotably extends through the lower end of an angled leg.

A pair of support assemblies 50 is provided. Each support assembly has a support bracket 52. Each support assembly has an upper arm 54 and a lower arm 56. Each upper arm has an upper end with a pin 58. The pin extends through the upper end and through an angled leg adjacent to its upper end. Each upper arm has a lower end with a pin 60. The pin extends through the lower end and through a support bracket. Each lower arm has a lower end with a pin 62. The pin extends through the lower end and through a horizontal leg adjacent to its second end. Each lower arm has an upper end with a pin 64. The pin extends through the upper end and through a support bracket. The open frame is adapted to be held in an operative orientation. The arms are in alignment and the legs are at an angle. The frame is adapted to be held in an inoperative orientation. The arms are in closely spaced parallelism. The legs are also in closely spaced parallelism.

Provided next is a lower hoop 68 with an intermediate plate 70. The intermediate plate is formed with a central section positionable in facing contact with the secondary section of the connecting plate, and with two fingers extending rearwardly at the bottom of the central section, and with an upper section positionable extending rearwardly at the top of the central section in facing contact with the primary section of the connecting plate. The lower loop is formed of rigid structural material such as steel band. The lower hoop has a diameter slightly smaller than the diameter of the mouth of a sandbag. In this manner a sandbag may be inserted and slightly overlapped such as to hold the sandbag in an upright open position for being filled. The lower hoop is welded and connects the lower loop to the center of the central section of the intermediate plate. In this manner the lower loop is fixedly centered between the legs and above the centers of the legs.

Further provided is an upper hoop 74. The upper hoop is formed of the same material as the first horizontal hoop. The second horizontal hoop has a diameter slightly larger than the diameter of the mouth of a first hoop. The second hoop has an operative position such that it is centered over the first horizontal hoop. In this manner a sandbag is allowed to be inserted onto the first hoop and removably clamped between the first and second hoops. The second hoop also has two pivoting bars 76 secured to the second hoop. In this manner the second hoop may be pivoted upwardly from the first hoop for removing a filled sand bag and for positioning an empty sandbag onto the system for filling.

Provided last is a securement assembly. The securement assembly allows for locking and unlocking of the intermediate plate with respect to the connecting plate. The securement assembly includes an aperture through the intermediate plate with a rod 80 extending through the aperture and slot. The rod has a finger 82 at its lower end. A handle 84 is provided above the apertures. In this manner the rotation of the handle and finger in one direction will position the finger below the intermediate plate to lock the intermediate plate with respect to the connecting plate. The rotation of the handle and finger in the opposite direction will position the finger in the slot of the connection plate to thereby unlock the intermediate plate with respect to the connecting plate. This will allow the rotational movement of the intermediate plate around the lower edge of the secondary section of the connecting plate and, consequently, the separation and connecting of the plates.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A sandbag filling system for supporting a sandbag in an upright position to enable a single person to rapidly and efficiently fill sandbags during emergency situations, the sandbag filling system being converted between an operative orientation for use and an inoperative orientation for storage and comprising, in combination:

an open frame having a U-shaped base with parallel horizontal legs, the horizontal parallel legs having first free ends and second ends with an integral horizontal connecting leg there between, the open frame also having a pivotable support with parallel angled legs, the parallel angled legs having lower ends and upper ends with a connecting plate there between, the connecting plate having an L-shaped cross sectional configuration with a primary section above the frame with a slot and a downwardly extending vertical section, the legs being formed of rigid structural material such as tubular steel, the open frame also having a pair of pivot brackets, each pivot bracket having a lower pin pivotably extending through the first end of a horizontal leg and an upper pin pivotably extending through the lower end of an angled leg;

a pair of support assemblies, each support assembly having a support bracket and an upper arm and a lower arm, each upper arm having an upper end with a pin extending there through and through an angled leg adjacent to its upper end, each upper arm having a lower end with a pin extending there through and through a support bracket, each lower arm having a lower end with a pin extending there through and through a horizontal leg adjacent to its second end, each lower arm having an upper end with a pin extending there through and through a support bracket, the open frame adapted to be held in an operative orientation with the arms in alignment and the legs at an angle, the frame adapted to be held in an inoperative orientation with the arms in closely spaced parallelism and the legs also in closely spaced parallelism;

a lower hoop formed of rigid structural material such as steel band with an intermediate plate, the intermediate plate being formed with a central section, and with two fingers extending rearwardly at the bottom of the central section, and with an upper section positionable extending rearwardly at the top of the central section, the lower hoop having a diameter slightly smaller than the diameter of the mouth of a sandbag wherein the sandbag may be inserted and slightly overlapped such as to hold the sandbag in an upright open position for being filled, the lower hoop is welded and coupled to the lower loop to the center of the central section of the intermediate plate such that the lower loop is fixedly centered between the legs and above the centers of the legs;

an upper hoop formed of the same material as the lower hoop, the upper hoop having a diameter slightly larger than the diameter of the mouth of the lower hoop, the upper hoop having an operative position such that it is centered over the lower hoop to allow a sandbag inserted onto the lower hoop and removably clamped between the lower and upper hoops, the upper hoop also having two pivoting bars secured thereto whereby the upper hoop may be pivoted upwardly from the lower hoop for removing a filled sand bag and for positioning an empty sandbag onto the system for filling; and a securement assembly for allowing locking and unlocking of the intermediate plate with respect to the connecting plate, the securement assembly including an aperture through the intermediate plate with a rod extending through the aperture and through the slot, the rod having a finger below the aperture and a handle above the aperture whereby the rotation of the handle and finger in one direction will lock the intermediate plate with respect to the connecting plate and the rotation of the handle and finger in the opposite direction will unlock the intermediate plate with respect to the connecting plate.

2. A sandbag filling system comprising:

an open frame having a base with horizontal parallel legs with first free ends and second ends with an integral horizontal connecting leg there between, the open frame having a pivotable support with angled legs with lower ends and upper ends with a connecting plate there between, the open frame also having a pair of pivot brackets each having a lower pin pivotably extending through the first end of a horizontal leg and an upper pin pivotably extending through the lower end of an angled leg;

a cylindrical lower hoop coupled to the connecting plate; and a cylindrical upper hoop having an operative position such that it is centered over the lower hoop, the upper hoop having a plate secured thereto whereby the upper hoop may be rotated from the lower hoop.

3. The system as set forth in claim 2 and further including a pair of support assemblies, each support assembly having a support bracket and an upper arm and a lower arm, each upper arm having an upper end with a pin extending there through and through an angled leg adjacent to its upper end, each upper arm having a lower end with a pin extending there through and through a support bracket, each lower arm having a lower end with a pin extending there through and through a horizontal leg adjacent to its second end, each lower arm having an upper end with a pin extending there through and through a support bracket, the open frame adapted to be held in an operative orientation with the arms in alignment and the legs at an angle, the frame adapted to be held in an inoperative orientation with the arms in closely spaced parallelism and the legs also in closely spaced parallelism.

4. The system as set forth in claim 2 and further including a securement assembly with an intermediate plate having an aperture and for allowing locking and unlocking of the intermediate plate with respect to the connecting plate, the securement assembly including an aperture through the intermediate plate with a rod extending through the aperture and through a slot in the connecting plate, the rod having a finger below the aperture and a handle above the aperture whereby the rotation of the handle and finger in one direction will lock the intermediate plate with respect to the connecting plate and the rotation of the handle and finger in the opposite direction will unlock the intermediate plate with respect to the connecting plate.

* * * * *